US010719026B2

(12) United States Patent
Bennett et al.

(10) Patent No.: US 10,719,026 B2
(45) Date of Patent: Jul. 21, 2020

(54) MONOCHROMATIC IMAGING WITH REDUCED COLORED TONER CONSUMPTION AND ESD DEFECTS

(71) Applicant: LEXMARK INTERNATIONAL, INC., Lexington, KY (US)

(72) Inventors: Christopher Michael Bennett, Paris, KY (US); Andrew Pryse Dale, Lexington, KY (US); Matthew David Heid, Simpsonville, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 69 days.

(21) Appl. No.: 16/032,273

(22) Filed: Jul. 11, 2018

(65) Prior Publication Data

US 2020/0019079 A1 Jan. 16, 2020

(51) Int. Cl.
*G03G 15/01* (2006.01)
*G03G 15/16* (2006.01)

(52) U.S. Cl.
CPC ..... *G03G 15/0194* (2013.01); *G03G 15/0126* (2013.01); *G03G 15/0131* (2013.01); *G03G 15/161* (2013.01); *G03G 2215/0177* (2013.01); *G03G 2215/0193* (2013.01)

(58) Field of Classification Search
CPC ..... G03G 15/0126; G03G 15/0131; G03G 15/0178; G03G 15/0189; G03G 15/0194; G03G 15/1605; G03G 15/161; G03G 2215/0177; G03G 2215/019; G03G 2215/0193; G03G 2215/0196
See application file for complete search history.

(56) References Cited

U.S. PATENT DOCUMENTS

| | | | | |
|---|---|---|---|---|
| 6,453,139 | B2 * | 9/2002 | Sasame | G03G 15/0194 399/167 |
| 6,795,671 | B2 | 9/2004 | Matsuoka | |
| 7,200,351 | B2 | 4/2007 | Ikeda et al. | |
| 7,706,731 | B2 | 4/2010 | Martin et al. | |
| 7,826,774 | B2 | 11/2010 | Cook et al. | |
| 8,005,391 | B2 | 8/2011 | Cook | |
| 9,977,376 | B1 | 5/2018 | Cook | |
| 2009/0142090 | A1 | 6/2009 | Wen et al. | |
| 2011/0158666 | A1 | 6/2011 | Furukawa | |
| 2011/0229203 | A1 * | 9/2011 | Nimura | G03G 15/0131 399/167 |

* cited by examiner

*Primary Examiner* — Sophia S Chen

(57) ABSTRACT

An imaging device prints in color and monochromatically, such as black-only. It has a plurality of photoconductive drums, one each for black toner and at least one colored toner. The drums contact and rotate with an intermediate transfer member (ITM) to transfer images at a first transfer. During black-only imaging, the photoconductive drum for the black toner rotates with the ITM at process speed while the drum for the at least one colored toner rotates at less than process speed, often substantially less. The technique reduces consumption of colored toner during black-only imaging and minimizes charge build-up on the drum for the colored toner.

5 Claims, 1 Drawing Sheet

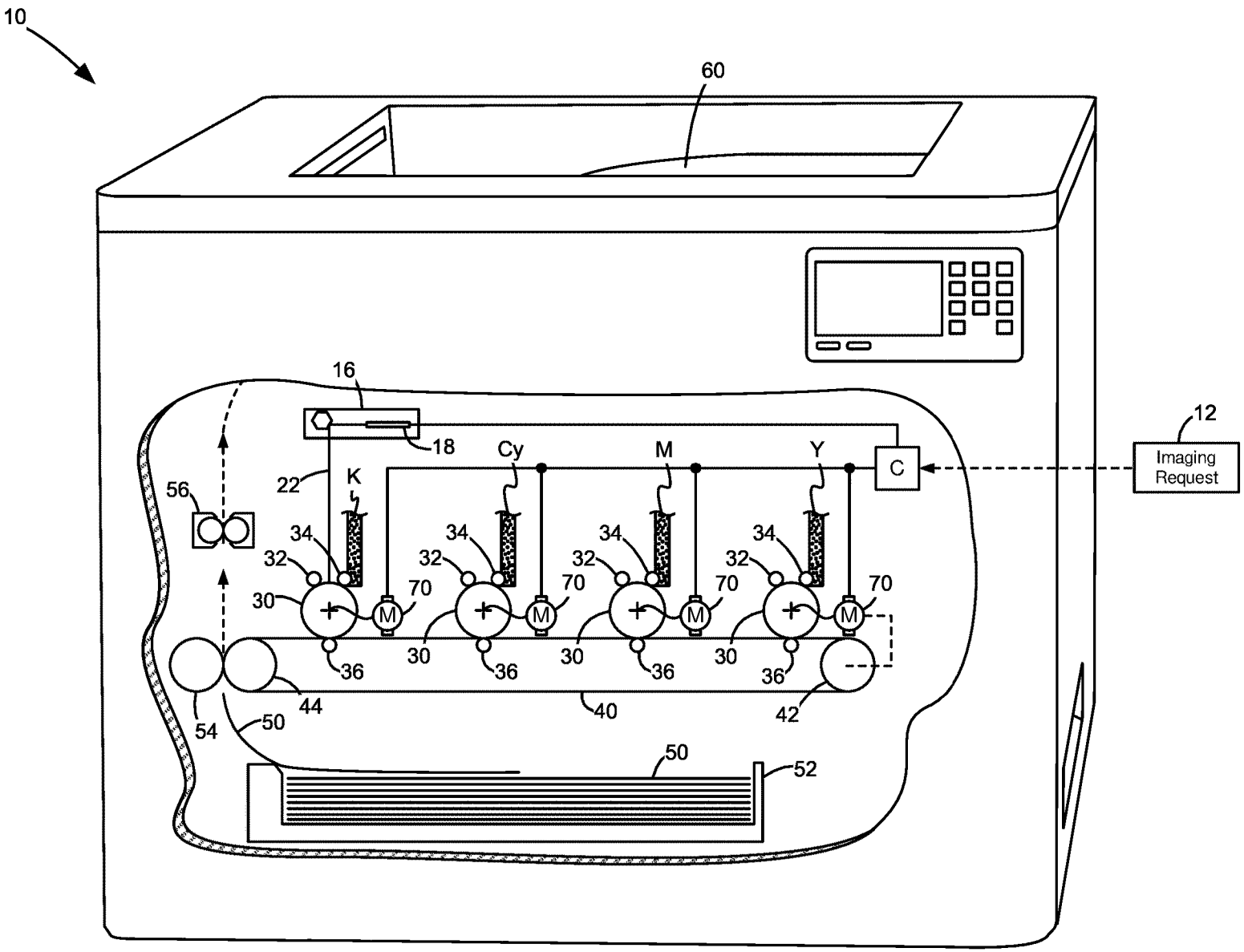
Imaging Request
12
C
Y
M
Cy
K
70
M
34
32
30
36
42
52
50
40
18
16
22
44
54
56
60
10

MONOCHROMATIC IMAGING WITH REDUCED COLORED TONER CONSUMPTION AND ESD DEFECTS

The present disclosure relates to electrophotographic imaging devices having black-only and color imaging, such as printers, copying machines, multifunction devices, etc. It relates further to controlling the consumption of colored toner and minimizing or eliminating electrostatic discharge (ESD) defects when imaging monochromatically, such as black-only.

BACKGROUND

Color imaging devices contain two or more cartridges. Each transfers a different color of toner to a media sheet as required to produce a full color copy of a toner image. A common imaging device includes four separate color cartridges—cyan, yellow, magenta, and black. Image formation for each of the four colors includes moving toner from a reservoir to an imaging unit where toned images, black or color are formed on photoconductive (PC) drums prior to transfer to a media sheet or to an intermediate transfer member (ITM) for subsequent transfer to a media sheet.

When black-only imaging, mechanisms exist to separate or retract the PC drums for the colored toners from contacting the ITM so their respective motors can be stopped. As this stops the drums from rotating, color toner is not consumed. The mechanisms, however, add complexity and cost. Alternatively, PC drums for the colored toners are not retracted from contacting the ITM, but allowed to skid. This, however, causes an electrostatic charge to develop on the surfaces of the drums. To avoid ESD imaging defects, the drums are rotated occasionally to fully recharge them for subsequent imaging. The rotation uses colored toner even though no colored imaging takes place. The rotation also wears the drums. This can lead to early replacement. A need exists to overcome the foregoing problems.

SUMMARY

An imaging device prints in color and black-only. It has a plurality of photoconductive drums, one each for black toner and at least one colored toner. The drums contact and rotate with an intermediate transfer member (ITM) to transfer images. During black-only imaging, the photoconductive drum for the black toner rotates with the ITM at process speed while the drum for the colored toner rotates at less than process speed. If the process speed ranges from 2500-3000 rpm, the drum for the colored toner rotates at 1000 rpm or less, perhaps on the order of 15 rpm or less. If the process speed ranges from 75-400 mm/sec, the drum for the colored toner rotates at 10 mm/sec or less, perhaps on the order of 1 mm/sec. The technique reduces consumption of colored toner during black-only imaging. It also minimizes charge build-up on the drums for colored toners, which reduces ESD defects. No longer are complex retraction features needed to separate the ITM from the surface of the drums for the colored toner during monochromatic imaging.

BRIEF DESCRIPTION OF THE DRAWINGS

FIG. 1 is a diagrammatic view of an electrophotographic imaging device according to an example embodiment showing monochromatic imaging, such as black-only.

DETAILED DESCRIPTION OF THE EMBODIMENTS

With reference to FIG. 1, there is shown an imaging device 10 having black-only and color imaging capability. The device receives at a controller, C, an imaging request 12 for black-only or color imaging. The controller typifies an ASIC(s), circuit(s), microprocessor(s), or the like. The request comes from external to the imaging device, such as from a computer, laptop, smart phone, etc. It can also come internally, such as from a copying request. In any, the controller converts the request to appropriate signals for providing to a laser scan unit 16. The unit turns on and off a laser 18 according to pixels of the imaging request. A rotating mirror 18 and associated lenses, reflectors, etc. (not shown) focus a laser beam 22 onto one or more photoconductive drums 30, as is familiar. The drums correspond to supplies of toner, such as black (K) and one or more colored toners, such as cyan (Cy), magenta (M) and yellow (Y). A corona or charge roller 32 sets a charge on a surface of the drums 30 as the drums rotate. The laser beam 22 electrostatically discharges the drums to create a latent image. A developer roller 34 introduces toner to the latent image and such is electrostatically attracted to create a toned image on a surface of the drums. A voltage differential between the surface of the drums 30 and transfer rolls 36 transfers the toned image from the drums to a surface of an intermediate transfer member (ITM) 40. For monochromatic images, a toned image is applied to the ITM from a single photoconductive drum. For color images, toned images are applied from two or more photoconductive drums.

The ITM 40, being entrained about a drive roll 42 and one or more idler/tension rolls 44, moves in a process direction with the surface of the drums. A sheet of media 50 advances from a tray 52 to a transfer roll 54 where a second difference in voltage between the ITM and the roll causes the toned image to attract and transfer to the media 50. A fuser assembly 56 fixes the toned image to the media through application of heat and pressure. Users pick up the media from a bin 60 after it advances out of the imaging device.

The controller coordinates the timing of the image transfers and transportation of the media from tray to output bin. The controller provides signals or not to pluralities of motors to cause them to rotate or stop. Motors 70 drive the rotation of the drums 30. The motors may also drive more than one drum and/or the drive roll of the ITM belt, as noted by the dashed line at 42 in an alternate embodiment. The speed of rotation is dictated by the signal from the controller.

During monochromatic imaging, such as black-only, the controller operates the motors in a fashion to prevent ESD defects, but without needing to retract any drums from contacting the ITM or unduly consuming colored toner. Namely, the drum for the black toner rotates with the ITM at process speed for imaging, but the drums for the colored toners rotate at less than process speed while remaining in contact with the ITM. It has been found that rotating the drums for the colored toner at any speed less than process speed is sufficient. To characterize the process speed, it has been observed that the drum for the black toner typically rotates in a range of 2500-3000 revolutions per minute (rpm) during black-only imaging or, its surface velocity, moves in a range of 75-400 mm/sec depending upon diameter. In such situations, the rotation of the drum for any of the colored toners should be rotated at 1000 rpm or less, more particularly at 10-500 rpm or even 15 rpm or less. This amounts to a speed reduction of 60% or more compared to the process speed. In surface velocity, rotation of the drum for any of the colored toners should be 10 mm/sec or less, perhaps on the order of about 1 mm/sec or less. As any rotation of the drums for the colored toners expends toner, although no color imaging occurs on the media, the slower the rotation of the drums the better for avoiding consumption of colored toner during black-only imaging.

The foregoing description of several methods and example embodiments has been presented for purposes of illustration. It is not intended to be exhaustive or to limit the claims. Modifications and variations to the description are possible in accordance with the foregoing. It is intended that the scope of the invention be defined by the claims appended hereto.

The invention claimed is:

1. In an imaging device having color and black-only imaging occurring at a process speed, including a plurality of photoconductive drums one each for black toner and at least one colored toner and an intermediate transfer member, a method of black-only imaging, comprising:

determining whether said imaging is color or black-only;

if said black-only, rotating throughout the black-only imaging the photoconductive drum for the black toner at said process speed while rotating the photoconductive drum for the at least one colored toner at substantially less than said process speed; and during said black-only imaging, keeping in contact the intermediate transfer member and the photoconductive drum for the at least one colored toner, wherein the process speed in revolutions per minute ranges 2500-3000 rpm further including rotating the photoconductive drum for the at least one colored toner during the black-only imaging at 15 rpm or less.

2. The method of claim 1, further including rotating the photoconductive drum for the at least one colored toner and the intermediate transfer member in a same process direction.

3. The method of claim 1, further including providing a separate motor for said rotating the photoconductive drums for the black toner and the at least one colored toner.

4. The imaging device of claim 1, further including providing a plurality of motors, wherein one of the plurality of motors is configured to rotate at least one of the plurality of photoconductive drums and also the intermediate transfer member.

5. In an imaging device having color and black-only imaging occurring at a process speed, including a plurality of photoconductive drums one each for black toner and at least one colored toner and an intermediate transfer member, a method of black-only imaging, comprising:

determining whether said imaging is color or black-only;

if said black-only, rotating throughout the black-only imaging the photoconductive drum for the black toner at said process speed while rotating the photoconductive drum for the at least one colored toner at substantially less than said process speed; and during said black-only imaging, keeping in contact the intermediate transfer member and the photoconductive drum for the at least one colored toner, wherein the process speed in distance per time ranges 75-400 mm/sec further including rotating the photoconductive drum for the at least one colored toner during the black-only imaging at 15 rpm or less.

* * * * *